US006483437B1

(12) United States Patent
Gelchion et al.

(10) Patent No.: US 6,483,437 B1
(45) Date of Patent: Nov. 19, 2002

(54) COMPRESSED GAS VISUAL NOTIFICATION DEVICE FOR SIGNALING DISTRESS

(76) Inventors: Joseph Gelchion, 75 W. 41st St., Bayonne, NJ (US) 07002; Aaron Gindi, 902 First Ct., Brooklyn, NY (US) 11223

( * ) Notice: Subject to any disclaimer, the term of this patent is extended or adjusted under 35 U.S.C. 154(b) by 0 days.

(21) Appl. No.: 09/667,860

(22) Filed: Sep. 22, 2000

(51) Int. Cl.[7] ..... G08B 3/00; G08B 5/00; G08B 7/00

(52) U.S. Cl. ..... 340/691.1; 222/3

(58) Field of Search ..... 340/691.1, 574, 340/691.5, 691.7, 693.5; 361/232; 200/61.19; 222/3

(56) References Cited

U.S. PATENT DOCUMENTS

| | | | | | |
|---|---|---|---|---|---|
| 4,697,706 | A | * | 10/1987 | Schaller | 206/573 |
| 4,768,739 | A | * | 9/1988 | Schnee | 244/146 |
| 5,033,385 | A | * | 7/1991 | Zeren | 102/439 |
| 5,654,521 | A | * | 8/1997 | McDaniel | 102/348 |
| 5,803,791 | A | * | 9/1998 | Chiles | 446/475 |
| 6,047,644 | A | * | 4/2000 | Malecki et al. | 102/367 |
| 6,075,450 | A | * | 6/2000 | Clark | 340/691.1 |

* cited by examiner

*Primary Examiner*—John Tweel
(74) *Attorney, Agent, or Firm*—Ezra Sutton

(57) ABSTRACT

A compressed gas visual notification device for signaling distress is provided. The compressed gas visual notification device includes a device housing having outer walls and a bottom wall for forming an interior firing chamber with the outer walls having first and second openings. The compressed gas visual notification device also includes a firing mechanism disposed in the first opening in the outer walls; a safety switch disposed in said second opening in the outer walls; and an air actuator shell disposed in the interior firing chamber. The interior firing chamber includes the firing mechanism and an actuator mechanism for firing the air actuator shell. The air actuator shell includes outer walls and a bottom wall for forming an interior shell compartment and shell opening. The shell opening has a non-porous shell membrane thereon. The interior shell compartment includes a quantity of compressed air under high pressure and a compressed gas dispersal receptacle member therein contained by the non-porous membrane. The compressed gas dispersal receptacle member includes an outer, non-porous receptacle membrane for containing therein a quantity of compressed inert, non-toxic gas at a high pressure. The compressed gas dispersal receptacle member also includes a quantity of aerosol, non-toxic micro-dispersion colored particles therein for adding color to the compressed gas. Actuation of the firing mechanism activates the air actuator shell so that the compressed gas and colored particles are released into the atmosphere as a visual notification device.

17 Claims, 5 Drawing Sheets

COMPRESSED GAS VISUAL NOTIFICATION DEVICE FOR SIGNALING DISTRESS

FIELD OF THE INVENTION

This invention relates to a visual notification and signaling device for signaling distress using a colored compressed gas in the event of an accident in order to alert others that the user is in the need of assistance. More particularly, the compressed gas visual signaling device includes a canister having a firing mechanism for activating the release of a compressed gas dispersal receptacle/member into the atmosphere in order to disperse the brightly colored gas from the gas receptacle.

BACKGROUND OF THE INVENTION

Distress signaling devices are used throughout the world for alerting rescuers to the user's location because of an accident, crash, incapacitation of a user or victim, an attack by a criminal, or some type of an outdoor emergency condition such as a flood, explosion, earthquake and the like. Typical outdoor distress signaling devices include flashlights, flare guns, mirrors, balloons, signaling lamps, torches and the like.

Typically, these distress signaling devices are cumbersome, troublesome, bulky, heavy, not readily available and hard to use when an emergency condition arises. Not every attempt at using these distress signaling devices are successful because of defects and problems associated with the equipment such as dead batteries, inoperative flare shells/cartridges, burnt-out bulbs, wet equipment because of rain, humidity or moisture.

There remains a need for a self-contained visual notification device for signaling distress in an emergency condition using a compressed gas dispersal receptacle for releasing and dispersing a brightly colored gas into the atmosphere. Additionally, the visual notification device would include an air actuator cartridge shell which is activated from a canister type housing having a firing mechanism therein in the form of a slide switch, trigger, pull switch or push-button. Further, the compressed gas would be helium gas (He) having an aerosol colorant dispersion system therein, being in the form of aerosol dispersion particles which give off a red, blue, green, orange or yellow color for attracting the attention of others when the colored gas is dispersed into the air.

DESCRIPTION OF THE PRIOR ART

Distress signaling devices, personal defense devices, personal alarm systems, personal security devices, self-defense devices and audio alarm/gas deterrent devices having various designs, structures, configuration and materials of construction have been disclosed in the prior art. For example, U.S. Pat. No. 4,223,804 to Morris et al discloses a personal defense device. This portable defense device combines a flashlight with a renewable, interchangeable cylinder containing compressed gas which may be used to generate a noise, to disperse dye and/or an odoriferous spray. The compressed gas may be stored in a canister which may take the form of a spray can.

U.S. Pat. No. 4,449,474 to Mario discloses a personal security device 11. This personal security device includes a trigger actuated aerosol canister contained in a two-piece telescoping housing. The canister contains a pressurized gas having an offensive odor such as mercaptoethanol which, when ejected from the canister, emits a loud shrieking noise. Additionally, the gas may, as an additional additive, contain a suspension of fine solid or liquid particles of paint or stain so that the device when actuated, discourages a potential rapist or attacker with offensive odor and noise and also identifies him with a stain. The telescoping housing also includes a flash-type light which is actuated by the same triggers which actuate the canister. The telescoping housing has a key ring attached at one end and may also have a mechanical whistle at the other end.

U.S. Pat. No. 5,529,215 to Banks et al discloses a personal defense baton 10 which is utilized to direct a spray of a personal defense gas toward an assailant. Additionally, the compressed gas can include a UV light sensitive dye for suspect identification by the police. The personal defense baton includes an elongated tube member having at one end a compartment for receiving a defense spray container. The defense spray container has a valve for dispersal of a personal defense gas and a discharge nozzle which communicates with the valve so as to direct a spray of the personal defense gas from the container. The baton also includes apparatus for manually actuating the valve without bringing the actuating hand near the discharge nozzle.

U.S. Pat. Nos. 4,431,118; 5,075,671; 5,289,164; 5,358,144; 5,429,301 and 5,635,908 all disclose small portable anti-attack repellant devices, personal defense devices, personal security devices, personal alarm systems, self defense devices, and audio alarm and gas deterrent devices. These devices are in the form of jewelry such as pins, bracelets; clothing-type articles such as a wrist wrap, a hand glove; and electronic equipment such as a beeper and an audio CD cassette. All of these prior art devices use the compressed gas contained within a canister/cartridge in a dual function system where the compressed gas and a chemical (Mace, Teargas, Peppergas and the like) perform two functions: 1) it is used as a gas repellant spray to ward-off an attacker; and 2) the compressed gas is also used to produce an audio alarm or audio signal from a horn, whistle, or screech producing devices. These prior art patents do not disclose or teach a visual colored gas alarm device that uses a colored compressed gas to produce and give off a visual colored gas notification signal to attract the attention of others in an outdoor setting. Instead, these prior art patents always use the compressed gas for the dual functions of a repellant to fend-off/ward off an assailant and also the compressed gas is used to produce an audio alarm, as opposed to the visual signal of the present invention.

Accordingly, it is an object of the present invention is to provide a self-contained visual notification device for signaling distress in an emergency situation using a compressed gas dispersal receptacle for releasing and dispersing a brightly colored gas into the atmosphere via an air actuator cartridge shell being activated from a canister-type housing having a firing mechanism thereon being in the form of a slide switch, trigger or push button.

Another object of the present invention is to provide a visual signaling device that uses helium gas (He) or other inert (non-volatile) gases having aerosol colored particles therein being in the form of an aerosol colorant dispersion system which gives off a red, blue, green, orange or yellow color in order to attract the attention of others when the colored gas is released and dispersed into the atmosphere.

Another object of the present invention is to provide a visual signaling device having air actuator cartridge/canister for firing the compressed gas dispersal receptacle being made of a durable, light-weight plastic, metal or plasticized metal having a fashionable aesthetic and/or practical presentation.

Another object of the present invention is to provide a visual signaling device being in the form of a piece of jewelry, timepiece (wristwatch), clothing article, part of a nap-sack, cosmetic container, communication beeper and the like.

Another object of the present invention is to provide a visual signaling device that is compact, light-weight, easy to use, portable, convenient and durable.

Another object of the present invention is to provide a visual signaling device for signaling distress in the event of an accident in order to alert others that the user is in the need of assistance, or in the event of an attack by a criminal in order to ward off the potential assailant. Other examples for using this visual signaling device is when a child is separated from his/her parents in an amusement park, resort areas, etc.; or when an elderly individual is incapacitated in their backyard, or other outdoor areas; or in any type of outdoor emergency conditions where someone needs to attract and signal another person for help and assistance.

Another object of the present invention is to provide a visual signaling device that is reusable and inexpensive to use having affordable (low cost) replacement compressed gas dispersal receptacles for reloading the air actuator cartridge/canister.

Another object of the present invention is to provide a visual signaling device that has a compressed gas dispersal receptacle that explodes outwardly when released into the air via the air actuated/actuator cartridge.

A further object of the present invention is to provide a visual signaling device and compressed gas dispersal receptacles that can be mass produced in an automated and economical manner and is readily affordable by the user.

SUMMARY OF THE INVENTION

In accordance with the present invention, there is provided a compressed gas visual notification device for signaling distress. The compressed gas visual notification device includes a device housing having outer walls and a bottom wall for forming an interior firing chamber with the outer walls having first and second openings. The compressed gas visual notification device also includes a firing mechanism disposed in the first opening in the outer walls; a safety switch disposed in said second opening in the outer walls; and an air actuator shell disposed in the interior firing chamber. The interior firing chamber includes the firing mechanism and an actuator mechanism for firing the air actuator shell. The air actuator shell includes outer walls and a bottom wall for forming an interior shell compartment and shell opening. The shell opining has a non-porous shell membrane thereon. The interior shell compartment includes a quantity of compressed air under high pressure and a compressed gas dispersal receptacle member therein and being contained by the non-porous membrane. The compressed gas dispersal receptacle member includes an outer, non-porous receptacle membrane for containing therein a quantity of compressed inert, non-toxic gas at a high pressure. The compressed gas dispersal receptacle member also includes a quantity of aerosol, non-toxic micro-dispersion colored particles therein for adding color to the compressed gas. Actuation of the firing mechanism activates the air actuator shell so that the compressed gas and colored particles are released into the atmosphere as a visual notification device.

BRIEF DESCRIPTION OF THE DRAWINGS

Further objects, features, and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT 10

Figure 4:
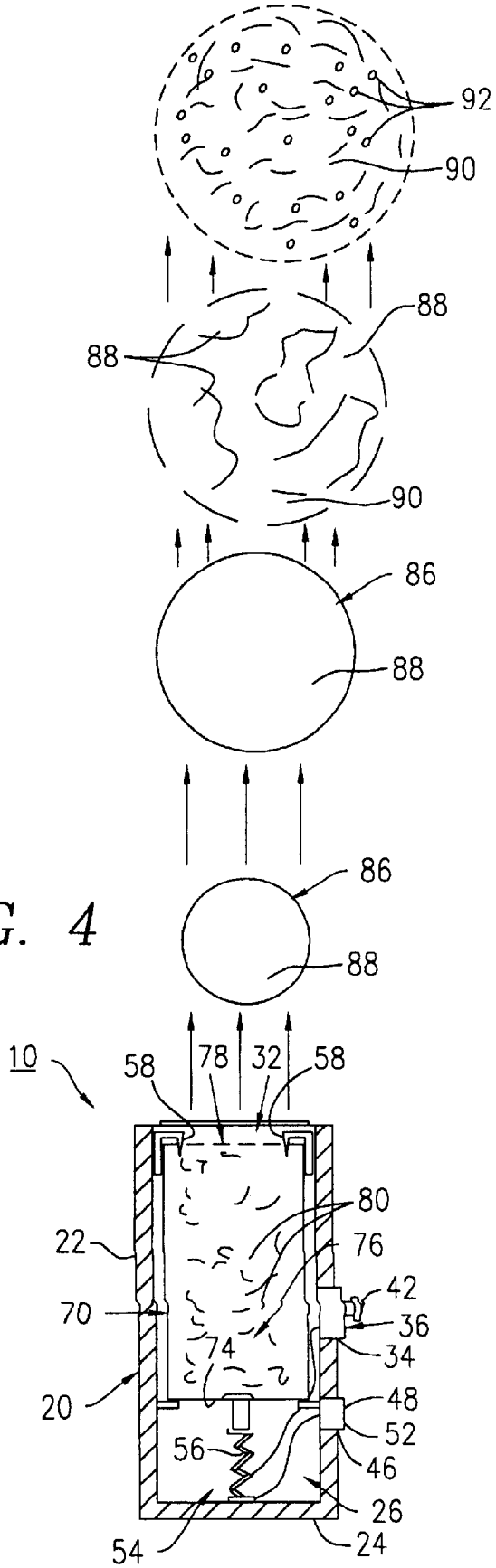
FIG. 4 is a cross-sectional view of the visual signaling device of the present invention taken along lines 4—4 of FIG. 1 showing the compressed gas dispersal receptacle member expanding and exploding into a red colored gas cloud signal for displaying the colorant dispersion particles thereof.
Figure 5:
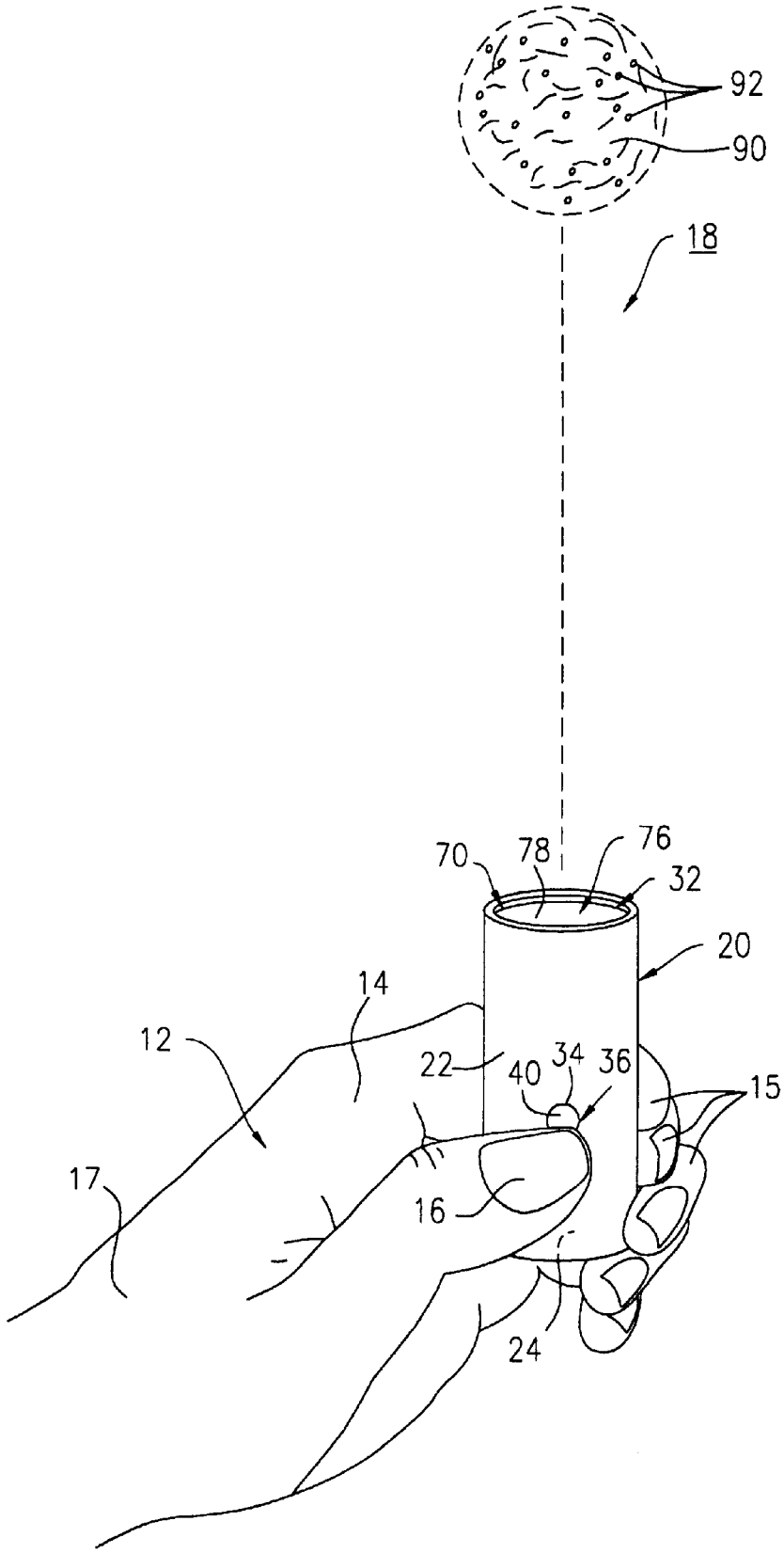
FIG. 5 is a perspective view of the visual signaling device of the present invention showing the self-contained visual signaling device in an assembled state and in operational use thereof.

The compressed gas visual notification device 10 and its component parts of the preferred embodiment of the present invention are represented in detail by FIGS. 1 through 5 of the patent drawings the compressed gas visual notification device 10 is used for signaling distress by a display of a colored compressed gas 90 in the event of an accident in order to alert others that the user 12 is in the need of assistance, as depicted in FIGS. 4 and 5 of the drawings. The compressed gas visual notification device 10, as shown in FIGS. 1 through 4, includes a small canister-type housing 20 having a firing mechanism 36 and an actuator mechanism 54 therein, and having an air actuator cartridge/shell 70 therein for releasing a compressed gas dispersal receptacle/member 86 into the atmosphere 18 in order to disperse the brightly colored gas 90 from the gas actuator shell 70.

Figure 1:
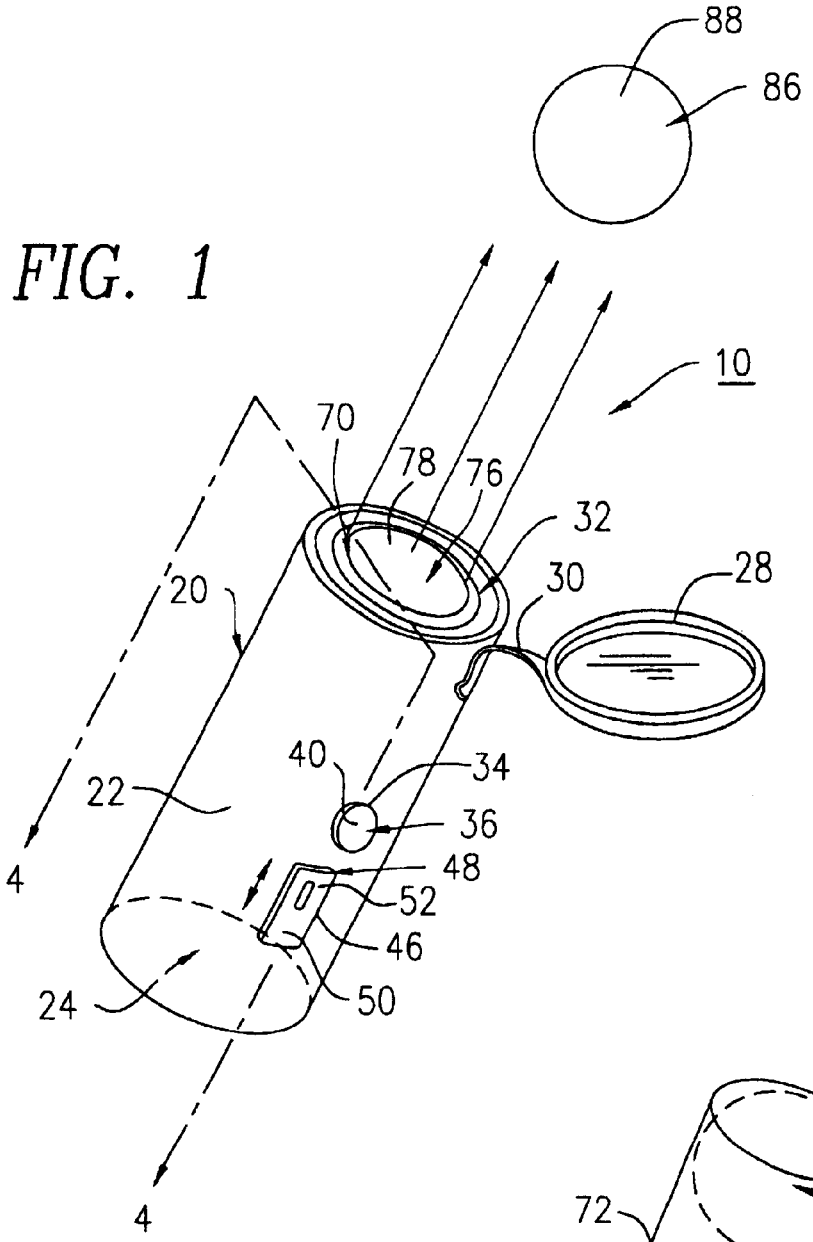
FIG. 1 is a front perspective view of the visual signaling device of the preferred embodiment of the present invention showing the device housing having an air actuated firing shell therein for the firing and releasing of the compressed gas dispersal receptacle member into the atmosphere.
Figure 3:
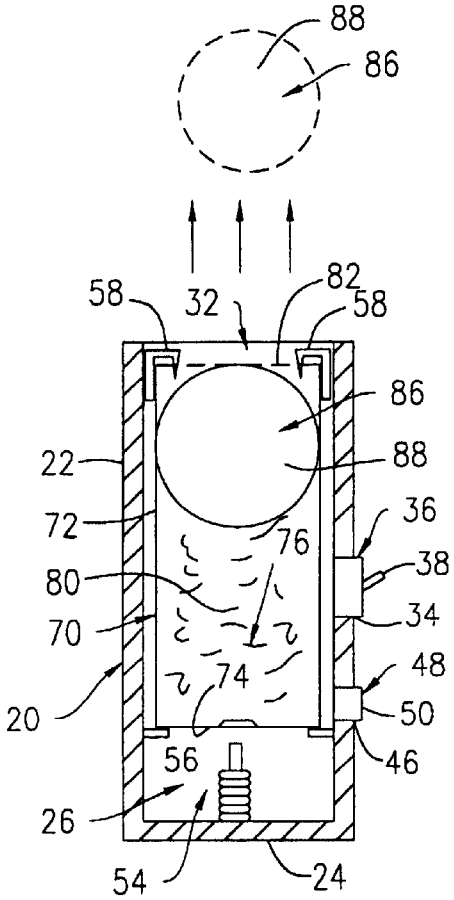
FIG. 3 is a cross-sectional view of the visual signaling device of the present invention showing the air actuated firing shell having the compressed gas dispersal receptacle member therein ready for firing from the device housing thereof.

Canister-type housing 20 being in the shape of a film canister, as shown in FIGS. 1, 3 and 4 of the drawings, includes an outer curved cylindrical wall 22, and a bottom circular wall 24 for forming an interior firing chamber 26 thereof. Canister-type housing 20 also includes a removable cap 28 having a retaining strap 30 thereon for covering the chamber opening 32 of interior firing chamber 26 for preventing any moisture, dust, or dirt from contaminating the working of the interior firing chamber 26 in firing off of the air actuator shell 70. Outer curved cylindrical wall 22 includes a first (circular) opening 34 for receiving therein a firing mechanism 36 in the form of a trigger 38, a push button 40, a pull switch 42, or a slide switch 44, and a second (rectangular) opening 46 for receiving therein a safety switch 48 having an "ON" position 50 and an "OFF" position 52 in order to inactivate or activate firing mechanism 36 accordingly.

Figure 2:
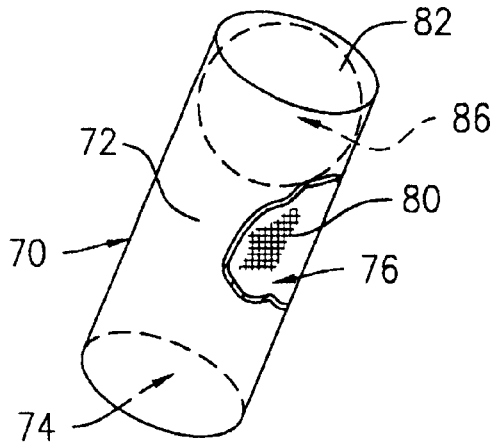
FIG. 2 is a front perspective view of the visual signaling device of the preferred embodiment of the present invention showing the air actuated firing cartridge shell having the compressed gas dispersal receptacle member therein.

Firing mechanism 36 then activates (when in the "OFF" position 52 of safety switch 48) the actuator mechanism 54 which in turn then actuates the air actuator shell 70 via the firing spring 56 and plurality of piercing pins 58. Air actuator shell 70 includes an outer curved cylindrical wall 72 and a bottom circular wall 74 for forming an interior shell compartment 76 and shell opening 78. Interior shell compartment 76 includes a sufficient amount of compressed air 80 under high pressure and a compressed gas dispersal receptacle member 86 being contained therein by a non-porous shell membrane 82. Non-porous shell membrane 82 covers the shell opening 78 of interior shell compartment 76 of the air actuator shell 70, as depicted in FIG. 2 of the drawings.

The compressed gas dispersal receptacle member 86 being substantially in a spherical shape, as shown in FIGS. 1, 3 and 4 of the drawings, includes an outer non-porous, thin receptacle membrane 88 containing therein a quantity of compressed inert, non-toxic gas 90. Compressed gas dispersal receptacle member 86 also includes a quantity of aerosol, nontoxic micro-dispersion particles 92 therein for adding color to compressed gas 90. The compressed inert, non-toxic gas 90 is selected from the group consisting of helium (He), nitrogen ($N_2$), carbon dioxide ($Co_2$), neon (Ne) and other lighter than air 18 gases. The aerosol, non-toxic micro-dispersion particles 92 are selected from the group consisting of colorized acrylic polyesters, metallic and non-metallic micas, bismuth oxychloride, organic guanines (fish scales), equivalents and combinations thereof. These micro-dispersion particles 92 are made to impart glitter, sparkle, pearlescent glow when exposed to natural or artificial light. The micro-dispersion particles 92 include a color selected from the group consisting of red, blue, green, orange or yellow.

In order for the compressed gas dispersal receptacle member 86 to be released from air actuator shell 70, the piercing pins 58 rupture the non-porous membrane 82 on shell opening 78 which then propels the receptacle member 86 upwards into the atmosphere 18 via the compressed air 80 Receptacle member 86 then expands simultaneously which in turn ruptures the outer receptacle membrane 88, as shown in FIG. 4 of the drawings, where then the colored micro-dispersion particles 92 are dispersed into the atmosphere 18. Compressed air 80 within the air actuator shell 70 can propel receptacle member 86 upwardly a distance in the range of 1 foot to 60 feet, depending upon the pressure and volume of the compressed air 80 within the interior shell compartment 76 of air actuator shell 70.

The volume of shell compartment 76 is in the range of 5 cc to 50 cc having the pressure of the compressed air 80 in the range of 2 atmospheres to 5 atmospheres within shell compartment 76 of air actuator shell 70. The volume of receptacle member 86 is in the range of 2 cc to 20 cc having the compressed gas 90 pressure in the range of 2 atmospheres to 5 atmospheres within receptacle member 86.

Canister-type housing 20 can be made of non-porous, durable plastic or light-weight, formable metal such as stainless-steel, steel or aluminum. Air actuator shell 70 can be made of non-porous, durable plastic, non-porous cardboard or a formable, light-weight metal. Shell membrane 82 can be made of a non-porous plastic sheet material or a non-porous paper sheet material. Receptacle membrane 88 can be made of a non-porous, slightly expandable plastic material.

DETAILED DESCRIPTION OF THE FIRST ALTERNATE EMBODIMENT 100

Figure 6:
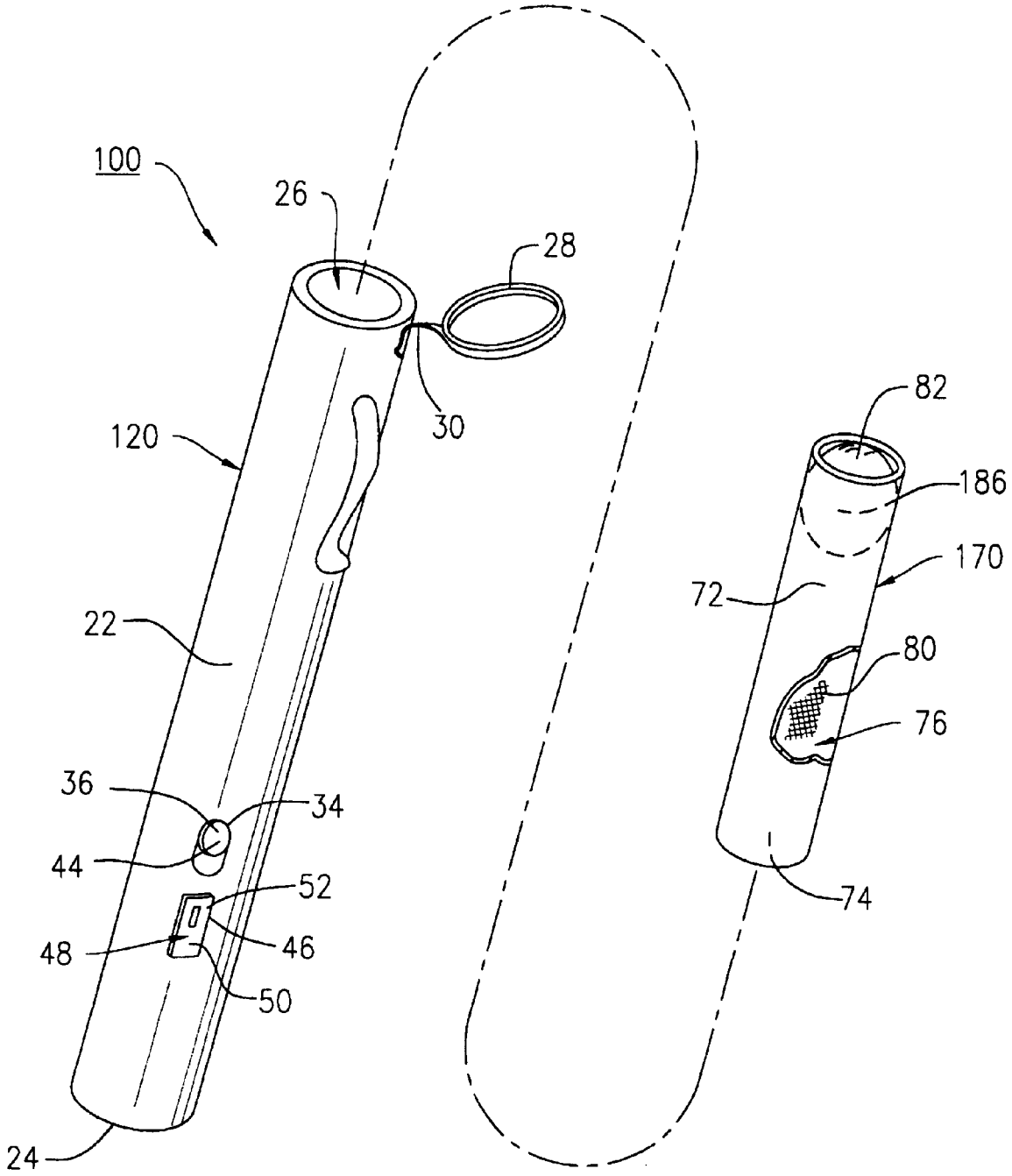
FIG. 6 is a front perspective view of the visual signaling device of the first alternate embodiment of the present invention showing the device housing and the air actuated firing shell containing the compressed gas dispersal receptacle member therein.

The compressed gas visual notification device 100 and its component parts of the first alternate embodiment of the present invention are represented in detail by FIG. 6 of the patent drawings. All aspects of the first alternate embodiment of the compressed gas visual notification device 100 are the same as the preferred embodiment of the compressed gas visual notification device 10, except for the shape and size of the device housing 120 being substantially a slender cylindrical shape in the form of a fountain pen and the air actuator shell 170 having also a slender cylindrical tube-like shape. Additionally, the compressed gas dispersal receptacle member 186 is substantially spherical in shape, but can have other shapes such as oval, cylindrical and the like. In operation, the first alternate embodiment 100 also operates in a similar manner as the preferred embodiment 10.

DETAILED DESCRIPTION OF THE SECOND ALTERNATE EMBODIMENT 200

Figure 7:
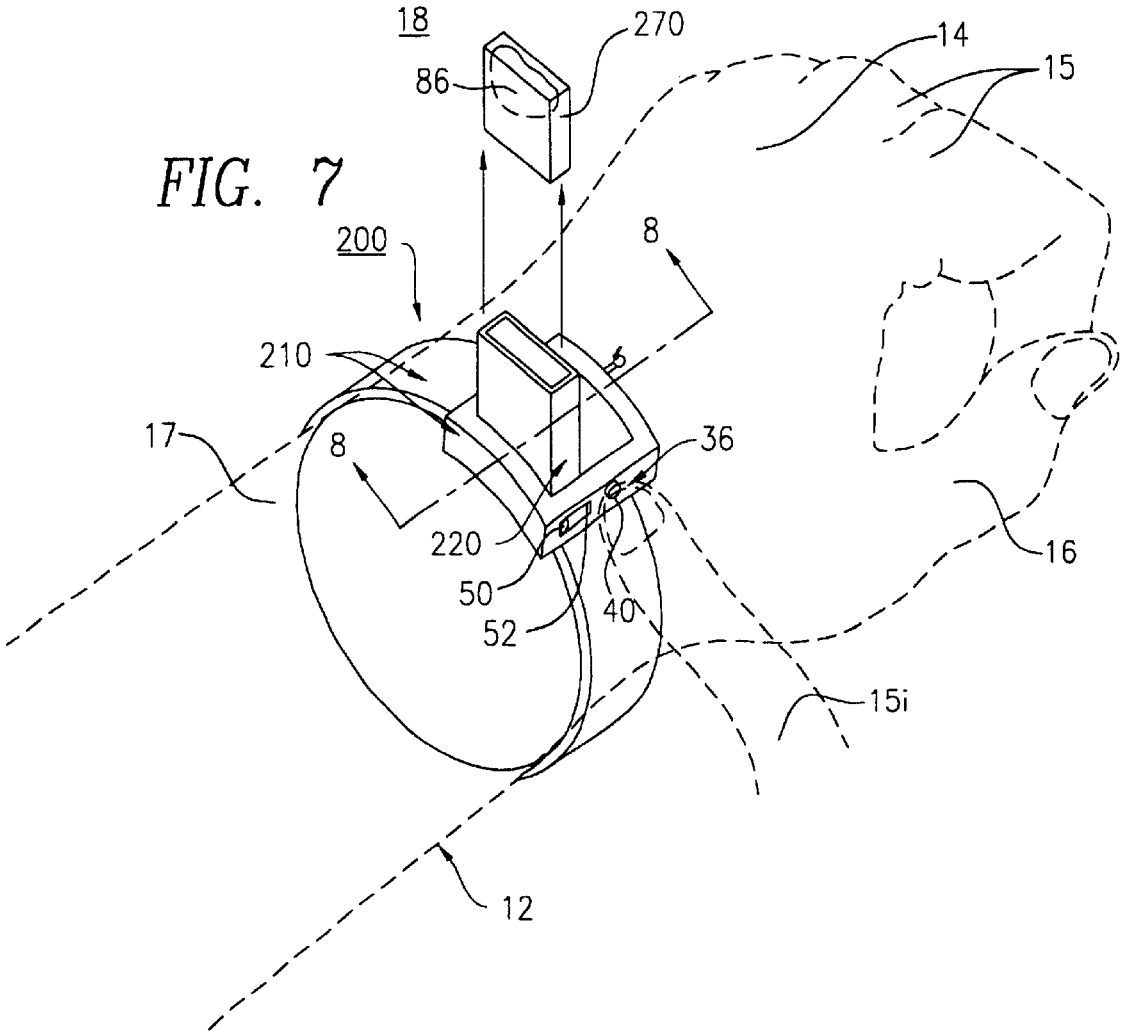
FIG. 7 is a front perspective view of the visual signaling device of the second alternate embodiment of the present invention showing the device housing and the air actuated firing shell containing the compressed gas dispersal receptacle member therein.
Figure 8:
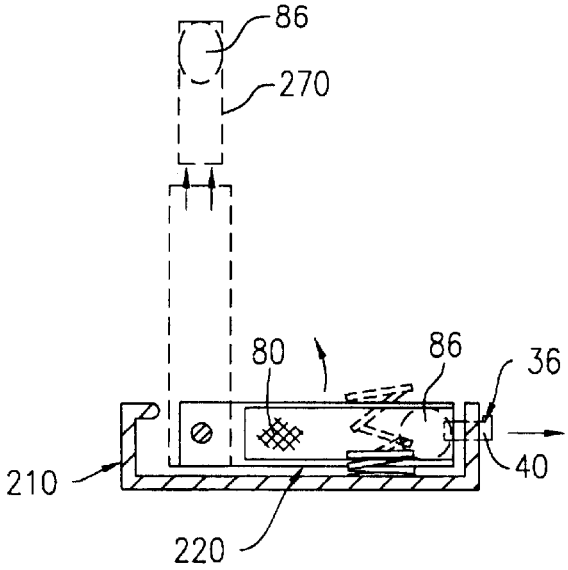
FIG. 8 is a cross-sectional view of the visual signaling device of the second alternate embodiment of the present invention taken along lines 8-8 of FIG. 7 showing the major component parts therein.

The compressed gas visual notification device 200 and its component parts of the second alternate embodiment of the present invention are represented in detail by FIG. 7 of the patent drawings. All aspects of the second alternate embodiment of the compressed gas visual notification device 200 are the same as the preferred embodiment of the compressed gas visual notification device 10, except for the shape and size of the device housing 220 being substantially a slender rectangular box as part of wristband 210, and the air actuator shell 270 having also a slender rectangular tube-like shape. In operation, the second alternate embodiment 200 also operates in a similar manner as the preferred embodiment 10.

OPERATION OF THE PRESENT INVENTION

In operation, the compressed gas visual notification devices 10, 100 and 200 of the preferred and alternate embodiments are readily put into operational use by initially loading the device housing 20, 120 or 220 with an unfired air actuator shell 70, 170 or 270. The user 12 simply uncaps, unscrews or lifts off removable cap 28 from chamber opening 32 and inserts air actuator shell 70,170 or 270 within the interior firing chamber 26, where then the user 12 replaces cap 28 on chamber opening 32 to prevent any moisture, dust or dirt from interfering with the operation and functioning of the interior firing chamber 26, firing mechanism 36 and/or actuator mechanism 54 in order to fire-off air actuator shell 70,170 or 270 in a proper fashion. The user 12 also checks to see if safety switch 48 is in an "ON" position 50, so as not to prematurely or accidentally fire-off the air actuator shell 70, 170 or 270 when not in an operational use situation.

When an emergency condition arises, the user 12 simply uncovers cap 28 from device housing 20, 120 or 220 and places safety switch 48 in an "OFF" position 52, where then the compressed gas visual notification device 10, 100 or 200 is now ready to be fired, as shown in FIGS. 4 and 5 of the drawings. The user 12 places device housing 20 or 120 firmly in his/her hand 14, such that the user's fingers 15 are tightly gripping the outer curved cylindrical wall 22 and the user's thumb 16 or index finger 15i is on the trigger 38, push button 40, pull switch 42 or slide switch 44 for activating firing mechanism 36 in order to fire-off the receptacle member 86 or 186 of air actuator shell 70, 170 or 270 skyward. In the second alternate embodiment 200, the visual notification device is already on the user's wrist 17, where then the user 12 follows the aforementioned step to fire-off air actuator shell 270 skyward.

Once the user 12 activates the firing mechanism 36 by pulling trigger 38 or pull switch 42 or depressing downward on push button 40 or slide switch 44, the actuator mechanism 54 then actuates the firing spring 56 and plurality of piercing pins 58 within the interior firing chamber 26 of device housing 20, 120 or 220. This in turn propels the receptacle member 86 or 186 upwards (skyward) into the atmosphere 18 via the compressed air 80, as shown in FIGS. 4 and 5 of the drawings, a distance in the range of 1 foot to 60 feet into the air. Receptacle member 86 or 186 then expands and ruptures the outer nonporous membrane 88, as depicted in FIG. 4 of the drawings, where then the brightly colored micro-dispersion particles 92 are simultaneously dispersed into the atmosphere 18 in order to alert others that the user 12 is in the need of assistance.

The user 12 can reuse visual notification device 10, 100 or 200 again by simply removing the spent air actuator shell 70, 170 or 270 from the interior firing chamber 26 and replacing the spent shell 70, 170 or 270 with a new one, then closing the cap 28 on chamber opening 32 and putting the safety switch 48 in the "ON" position 50 to prevent misfiring. The notification device 10, 100 or 200 is now again ready for operational use for alerting others for signaling distress

ADVANTAGES OF THE PRESENT INVENTION

Accordingly, an advantage of the present invention is that it provides for a self-contained visual notification device for signaling distress in an emergency situation using a compressed gas dispersal receptacle for releasing and dispersing a brightly colored gas into the atmosphere via an air actuator cartridge shell being activated from a canister-type housing having a firing mechanism thereon being in the form of a slide switch, trigger or push button.

Another advantage of the present invention is that it provides for a visual signaling device that uses helium gas (He) or other inert (non-volatile) gases having aerosol colored particles therein being in the form of an aerosol colorant dispersion system which gives off a red, blue, green, orange or yellow color in order to attract the attention of others when the colored gas is released and dispersed into the atmosphere.

Another advantage of the present invention is that it provides for a visual signaling device having air actuator cartridge/canister for firing the compressed gas dispersal receptacle being made of a durable, light-weight plastic, metal or plasticized metal having a fashionable aesthetic and/or practical presentation.

Another advantage of the present invention is that it provides for a visual signaling device being in the form of a piece of jewelry, timepiece (wristwatch), clothing article, part of a nap-sack, cosmetic container, communication beeper and the like.

Another advantage of the present invention is that it provides for a visual signaling device that is compact, light-weight, easy to use, portable, convenient and durable.

Another advantage of the present invention is that it provides for a visual signaling device for signaling distress in the event of an accident in order to alert others that the user is in the need of assistance, or in the event of an attack by a criminal in order to ward off the potential assailant. Other examples for using this visual signaling device is when a child is separated from his/her parents in an amusement park, resort areas, etc.; or when an elderly individual is incapacitated in their backyard, or other outdoor areas; or in any type of outdoor emergency conditions where someone needs to attract and signal another person for help and assistance.

Another advantage of the present invention is that it provides for a visual signaling device that is reusable and inexpensive to use having affordable (low cost) replacement compressed gas dispersal receptacles for reloading the air actuator cartridge/canister.

Another advantage of the present invention is that it provides for a visual signaling device that has a compressed gas dispersal receptacle that explodes outwardly when released into the air via the air actuated/actuator cartridge.

A further advantage of the present invention is that it provides for a visual signaling device and compressed gas dispersal receptacles that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A compressed gas visual notification device for signaling distress, comprising:

a) a device housing having outer walls and a bottom wall for forming an interior firing chamber, said outer walls having a bottom wall for forming an interior firing chamber; said outer walls having first and second openings;

b) a firing mechanism disposed in said first opening in said outer walls;

c) a safety switch disposed in said second opening in said outer walls;

d) an air actuator shell disposed in said interior firing chamber;

e) said interior firing chamber including said firing mechanism and further including means for activation of said actuator shell;

f) said air actuator shell having outer walls and a bottom wall for forming an interior shell compartment and shell opening; said shell opening having a non-porous shell membrane thereon;

g) said interior shell compartment having a quantity of compressed air under high pressure and a compressed gas dispersal receptacle member therein and being contained by said non-porous membrane;

h) said compressed gas dispersal receptacle member including an outer, nonporous receptacle membrane for containing therein a quantity of compressed inert, non-toxis gas at a high pressure;

i) said compressed gas dispersal receptacle member including a quantity of aerosol, non-toxic micro-dispersion colored particles therein for adding color to said compressed gas; and j) wherein actuation of said firing mechanism activates said air actuator shell so that said compressed gas and colored particles are released into the atmosphere as a visual notification device.

2. A visual notification device in accordance with claim 1, wherein said firing mechanism is in the form of a trigger, push button, pull switch or slide switch.

3. A visual notification device in accordance with claim 1, wherein said means for activation includes an actuator mechanism.

4. A visual notification device in accordance with claim 3, wherein said actuator mechanism is in the form of a firing spring and a plurality of piercing pins for rupturing said shell membrane for propelling said dispersal receptacle member upwardly into the atmosphere.

5. A visual notification device in accordance with claim 1, wherein said inert, non-toxic gas is selected from the group consisting of helium, nitrogen, carbon dioxide, neon and other lighter than air gases.

6. A visual notification device in accordance with claim 1, wherein said aerosol, non-toxic micro-dispersion particles are selected from the group consisting of colorized acrylic polyesters, metallic and non-metallic micas, bismuth oxychloride, organic guanines, and combinations thereof.

7. A visual notification device in accordance with claim 6, wherein said aerosol, non-toxic micro-dispersion particles impart glitter, sparkle, or pearlescent glowing when exposed to natural or artificial light.

8. A visual notification device in accordance with claim 6, wherein said aerosol, non-toxic micro-dispersion colored particles include a color being selected from the group consisting of red, blue, green, orange or yellow.

9. A visual notification device in accordance with claim 1, wherein said safety switch includes an on position for inactivating said visual notification device and an off position for activating said visual notification device.

10. A visual notification device in accordance with claim 1, wherein said interior shell compartment has a volume capacity in the range of 5 cc to 50 cc and having said compressed air with an internal pressure in the range of 2 atmospheres to 5 atmospheres.

11. A visual notification device in accordance with claim 1, wherein said compressed gas dispersal receptacle member has a volume capacity in the range of 2 cc to 20 cc and having said compressed gas with an internal pressure in the range of 2 atmospheres to 5 atmospheres.

12. A visual notification device in accordance with claim 1, wherein said device housing is made from non-porous, durable plastic or light-weight, formable metal such as stainless steel, steel or aluminum.

13. A visual notification device in accordance with claim 1, wherein said air actuator shell is made from non-porous, durable plastic; non-porous cardboard or a formable, light-weight metal.

14. A visual notification device in accordance with claim 1, wherein said shell membrane is made of a non-porous plastic sheet material or a non-porous paper sheet material.

15. A visual notification device in accordance with claim 1, wherein said receptacle membrane is made of a non-porous slightly expandable plastic material.

16. A visual notification device in accordance with claim 4, wherein said dispersal receptacle member is propelled upwardly in the range of 1 foot to 60 feet into the atmosphere.

17. A visual notification device in accordance with claim 1, wherein said device housing is in the shape of a film canister, a fountain pen, or a wrist bracelet.

* * * * *